United States Patent [19]

Frick

[11] Patent Number: 4,523,183

[45] Date of Patent: Jun. 11, 1985

[54] ALARM-FAULT DETECTING SYSTEM

[75] Inventor: Kenneth L. Frick, Westminster, Colo.

[73] Assignee: AT&T Bell Laboratories, Murray Hill, N.J.

[21] Appl. No.: 374,338

[22] Filed: May 3, 1982

[51] Int. Cl.[3] ..... G08B 29/00

[52] U.S. Cl. ..... 340/507; 340/506; 340/508; 340/510; 340/511

[58] Field of Search ..... 340/507, 505, 506, 500, 340/501, 508, 511, 517, 518, 521, 531, 536, 537, 825.05, 825.54

[56] References Cited

U.S. PATENT DOCUMENTS

| | | | |
|---|---|---|---|
| 4,079,363 | 3/1978 | Wilson, Jr. | 340/508 |
| 4,253,091 | 2/1981 | Frydman | 340/508 |
| 4,283,717 | 8/1981 | Caldwell et al. | 340/508 |
| 4,414,539 | 11/1983 | Armer | 340/507 |
| 4,441,100 | 4/1984 | Galloway | 340/506 |

*Primary Examiner*—Donnie L. Crosland

*Attorney, Agent, or Firm*—F. W. Padden; Charles H. Davis

[57] ABSTRACT

A microcomputer controlled circuit arrangement for sensing fire and burglar alarms in the presence of undesired fault conditions, such as opens or shorts, on monitored communication lines. The arrangement includes transistor-resistor sensing circuitry which is shared by a plurality of monitored communication lines, each of which comprises a first pair of conductors connected to a first contact of an alarm sensor and a second pair of conductors connected to a second alarm sensor contact. The sensing circuitry is connected through a multiplexer to each one of the lines one at a time under control of the microcomputer to detect any fault thereon and any alarm provided by the sensor contacts. The sensing circuitry is responsive to impedance conditions on the four conductors furnishing a plurality of output voltages which are examined by comparators that, in turn, generate combinational logic voltages signifying the alarm-fault state of a monitored line.

27 Claims, 3 Drawing Figures

ALARM-FAULT DETECTING SYSTEM

TECHNICAL FIELD

This invention relates to facilities for detecting emergencies, such as fire and burglar alarms, even in the presence of an abnormality or fault in the signaling system.

BACKGROUND OF THE INVENTION

The signaling of alarms from remote locations over communication lines to an administration bureau is well known in the prior art. Typically, facilities at the administration bureau are arranged to examine the communication lines to sense impedance conditions thereon which signify the presence or absence of an alarm.

One of the problems in such an arrangement is that an occasional fault condition, such as an open or short on a signaling line conductor interferes with accurate alarm sensing and detection. The interference reduces the integrity and reliability of the alarm system and tends adversely to affect the safety of protected personnel and premises. The National Fire Protection Association (NFPA) recognizing those deficiencies has established regulations for the detection of an alarm despite the presence of an open or shorted conductor of the signaling line used for reporting the occurrence of that alarm.

SUMMARY OF THE INVENTION

It is an object of the present invention to provide an alarm-fault detecting system which complies with the NFPA regulations.

In accordance with an illustrative embodiment, a microcomputer controlled system is provided with alarm and fault sensing circuitry which is shared by a plurality of signaling lines extending to protected premises. The sensing circuitry is illustratively connected sequentially through a multiplexer to each of the lines one at a time under control of the microcomputer and to detect a fault condition thereon and any alarm provided by alarm sensor contacts at the protected premises.

A feature of my invention is that each contact of a pair of alarm sensor contacts is illustratively connected to a pair of signaling conductors which extend through the multiplexer to the sensing circuitry. The use of four conductors enhances the reliability and integrity of alarm and fault sensing and detection.

The illustrative alarm-fault sensing circuitry comprises a plural transistor-resistor network which is connectable through the multiplexer to the four signaling conductors for producing a plurality of output voltages in accordance with the impedance conditions of the four conductors. A plurality of comparator devices examine the produced output voltages and, in turn, generates combinational logic output voltages which signify the presence or absence of a faulty conductor and any alarm condition. The microcomputer then performs a memory table look-up operation to identify the specific alarm-fault condition for the protected premises and generates the appropriate alarm and/or fault report.

The microcomputer is programmed for initially activating a pair of transistors in the sensing circuitry to establish a unidirectional current flow through the resistor network. After verifying that transistor operation, the microcomputer addresses the multiplexer to effect a connection of the sensing circuitry to the four-conductors identified by the address. The impedance of the four-conductors influences that current flow. The resultant current flow produces four output voltages which are applied to the comparators in the sensing circuitry for generating a combination of six HIGH-LOW logic output voltages. The microcomputer proceeds by a table look-up to identify the specific open or shorted-to-ground conductor and any alarm indicated by the combinational logic voltages.

Under certain fault conditions, the microcomputer controls a reversal of the current flow through the transistor-resistor network and the four conductor loop in order to identify a specific fault condition without ambiguity. It does so by sending control signals to the sensing circuitry for deactivating the first pair of transistors and for activating a second pair of transistors in the network.

DETAILED DESCRIPTION

Figure 1:
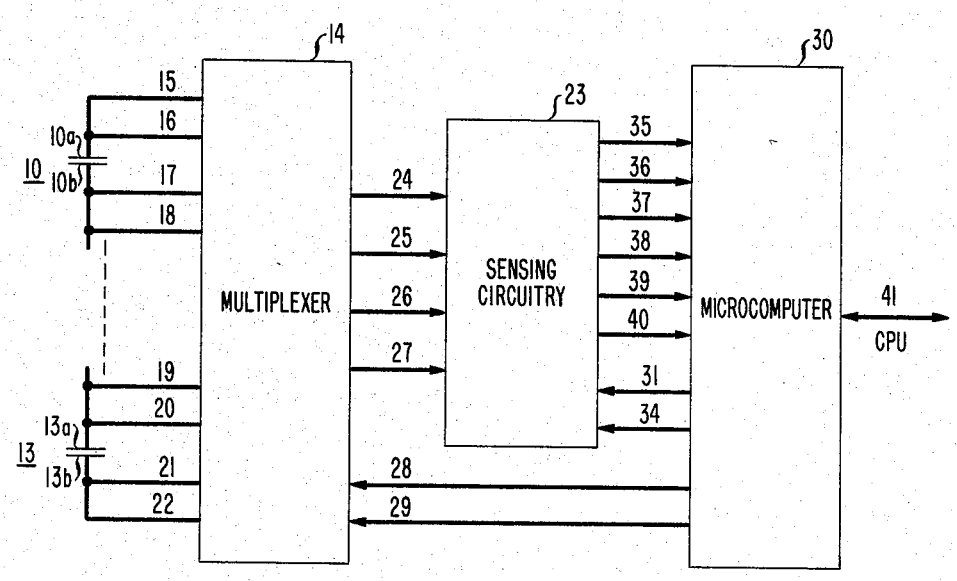
FIG. 1 is a block diagram of the sensing circuitry, microcomputer and multiplexer interconnected over alarm loop conductors with alarm sensor contacts.

In FIG. 1, a plurality of alarm sensor contacts 10–13 are illustratively used at protected premises for sensing alarms, such as fire and burglary. Each contact of a pair of the contacts 10–13 is connected over a first and a second pair of sensor conductors to a multiplexer 14. For example, each of the contacts 10*a* and 10*b* is connected to multiplexer 14 over loop conductors 15, 16 and 17, 18. Contacts 13*a* and 13*b* are connected to multiplexer 14 over a group of four conductors 19–22.

Multiplexer 14 functions as a sequential switching circuit to connect each of the contacts one pair at a time to time shared sensing circuitry 23 via conductors 24–27 and the respective groups of four conductors 15–18 through 19–22. The connections are sequentially established to monitor, or supervise an alarm sensed by the alarm contacts and any single wire open or single wire short-to-ground on the groups of four wires connecting contacts 10–13 to multiplexer 14. The connections are established by multiplexer 14 in response to control signals supplied over conductors 28 and 29 by a microcomputer 30. For example, the connection path for contacts 10 is via conductors 15–18, multiplexer 14, and conductors 24–27 to sensing circuitry 23.

Sensing circuitry 23 is controlled by the microcomputer 30 over conductors 31–34 to sense any nonfault or open conductor or shorted to ground conductor condition on any one of the connected group of four conductors, for example conductors 15–18, as well as, any alarm or nonalarm condition detected by the connected sensor contacts for example contacts 10. Circuitry 23 further signals the sensed condition and the affected conductor to the microcomputer 30 by combinational logic voltage over six conductors 35–40. Microcomputer 30 interprets the received voltages and, in turn, sends over cable conductors 41 to a central processing unit (not shown) coded signals specifying the identity of the protected premises, the alarm-nonalarm condition and the presence of any fault detected on the loop conductors.

Figure 2:
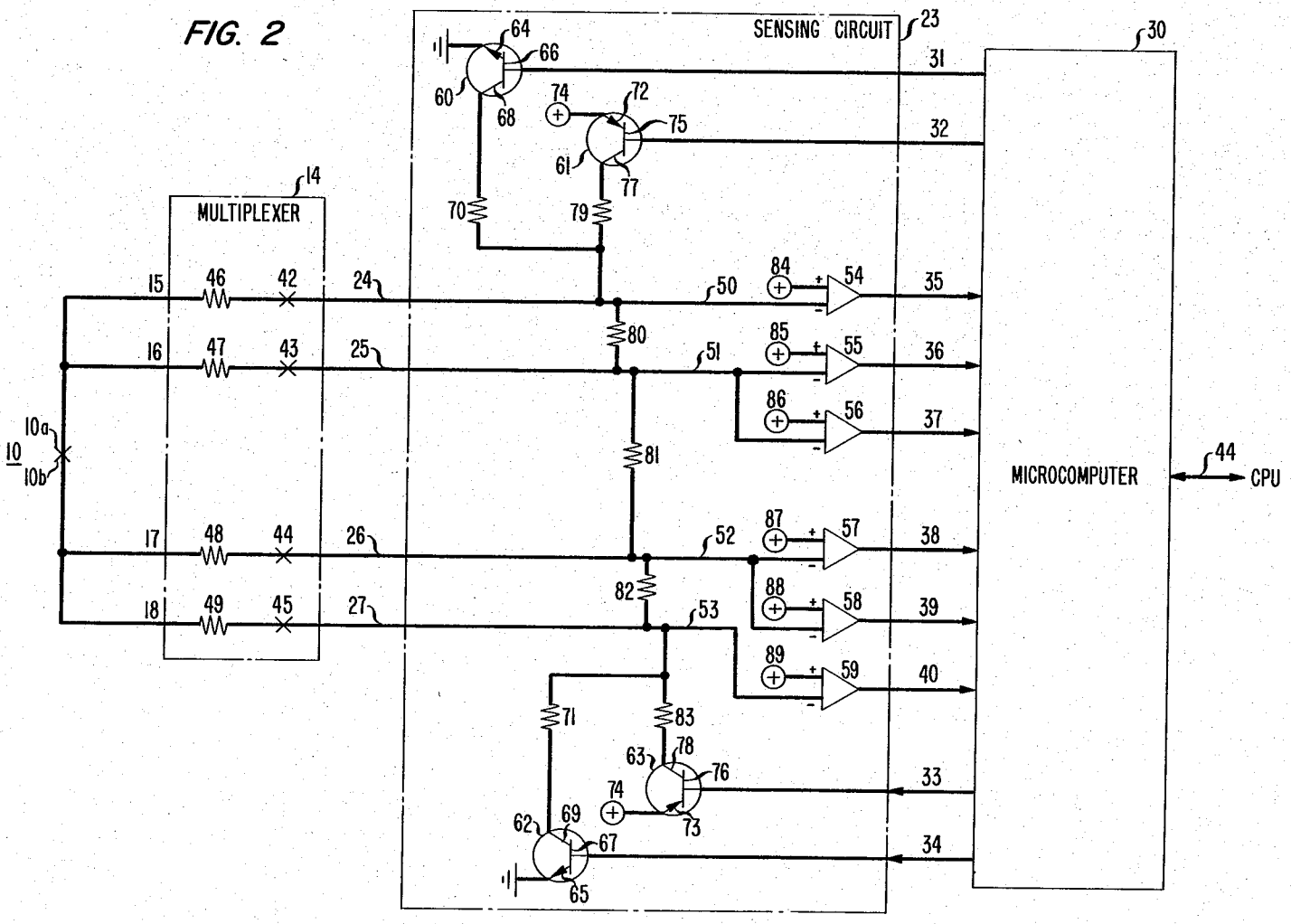
FIG. 2 schematically illustrates the sensing circuitry functionally connected to the alarm loop conductors and contacts.

In FIG. 2, multiplexer 14 is functionally shown interconnecting the sensor contacts 10 to the sensing circuitry 23 via the conductors 15–18 and 24–27. For the illustrative embodiment, the interconnecting is not permanent, but is a timewise interconnecting of conductors 15–18 and 24–27 via representative switch contacts 42–45 and respective individual resistors 46–49. Conductors 24–27 are sequentially connected individually to other sensor contacts, such as contacts 13 of FIG. 1 via conductors 19–22 in a manner similar to that used for contacts 10. The connections are suitably established in multiplexer 14 by known semiconductor or electromechanical sequential switching apparatus (not shown) under control of microcomputer 30. The contacts 42–45 functionally illustrate essentials of multiplexer 14. By way of example, the value of each of the resistors 46–49 approximates one-half of the impedance of the loop conductors 15–18.

FIG. 2 further illustrates that the sensing circuitry 23 comprises a transistor-resistor electrical network which is connectable via the multiplexer 14 to a monitored group of the four conductors 15–18 and the associated sensor contacts 10. That network in conjunction with the conductors 15–18 and contacts 10 supply voltages on conductors 50–53 which are examined by six comparators 54–59 in circuitry 23 for indicating any single wire open or single wire shorted-to-ground condition on the monitored wires 15–18 as well as an alarm or nonalarm signaled by contacts 10. The microcomputer 30 controls transistors 60–63 of that network over conductors 31–34 initially to establish the four voltages in accordance with a nonfault condition of the monitored conductors 15–18. In the absence of a detected short or open on conductors 15–18, the microcomputer 30 enables the comparators 54–59 to proceed with a detection of an alarm actuation or nonactuation of contacts 10 and, accordingly, signaling the microcomputer 30 over conductors 35–40. Whenever the comparators 54–59 detect a short or an open on one of the conductors 15 or 16, microcomputer 30 controls the transistors 60–63 over conductors 31–34 to switch the direction of current flow through the loop conductors 15–18 and the resistor network prior to a check of the alarm actuation or nonalarm nonactuation of contacts 10. Microcomputer 30 reports the condition of the loop conductors 15–18 and any alarm to the central processing unit over cable conductors 41.

Transistors 60 and 62 are NPN devices with each of their emitter electrodes 64 and 65 connected to ground potential. Base electrodes 66 and 67 of transistors 60 and 62 are connected over conductors 31 and 34 respectively to microcomputer 30 for loop current switching control. Collector electrodes 68 and 69 of transistor 60 and 62 are serially connected to an individual one of the conductors 50 and 53 via resistors 70 and 71.

Transistors 61 and 63 are PNP devices with each of their emitter electrodes 72 and 73 connected to a positive bias potential 74. Base electrodes 75 and 76 of transistors 61 and 63 are connected over conductors 32 and 33 to microcomputer 30 for loop current switching control. Collector electrodes 77 and 78 of transistors 61 and 63 are serially interconnected via resistors 79, 80, 81, 82 and 83.

Microcomputer 30 is illustratively equipped with a memory table (not shown) which stores combinations of HIGH-LOW logic state conditions corresponding to HIGH-LOW voltage state conditions on conductors 35–40. Those voltage states specify the individual nonalarm and alarm states of the sensing contacts and the absence or presence of any single wire open or single wire shorted-to-ground condition of the monitored group of four conductors, such as conductors 15–18 of FIG. 2.

Comparators 54–59 produce the combinational HIGH-LOW logic voltage states on conductors 35–40 by comparing the voltages concurrently supplied to the negative (−) inputs of those comparators via conductors 50–53 against fixed positive bias voltages 84–89 applied to the comparator positive (+) inputs. Each of the comparators 54–59 is a bistable device having an output connected to an individual one of the conductors 35–40 for supplying a LOW output voltage whenever the negative input voltage is greater than the positive bias voltage at the positive input for that comparator. A HIGH output voltage is produced in response to a negative input voltage less than the positive input bias voltage of the comparator.

Figure 3:
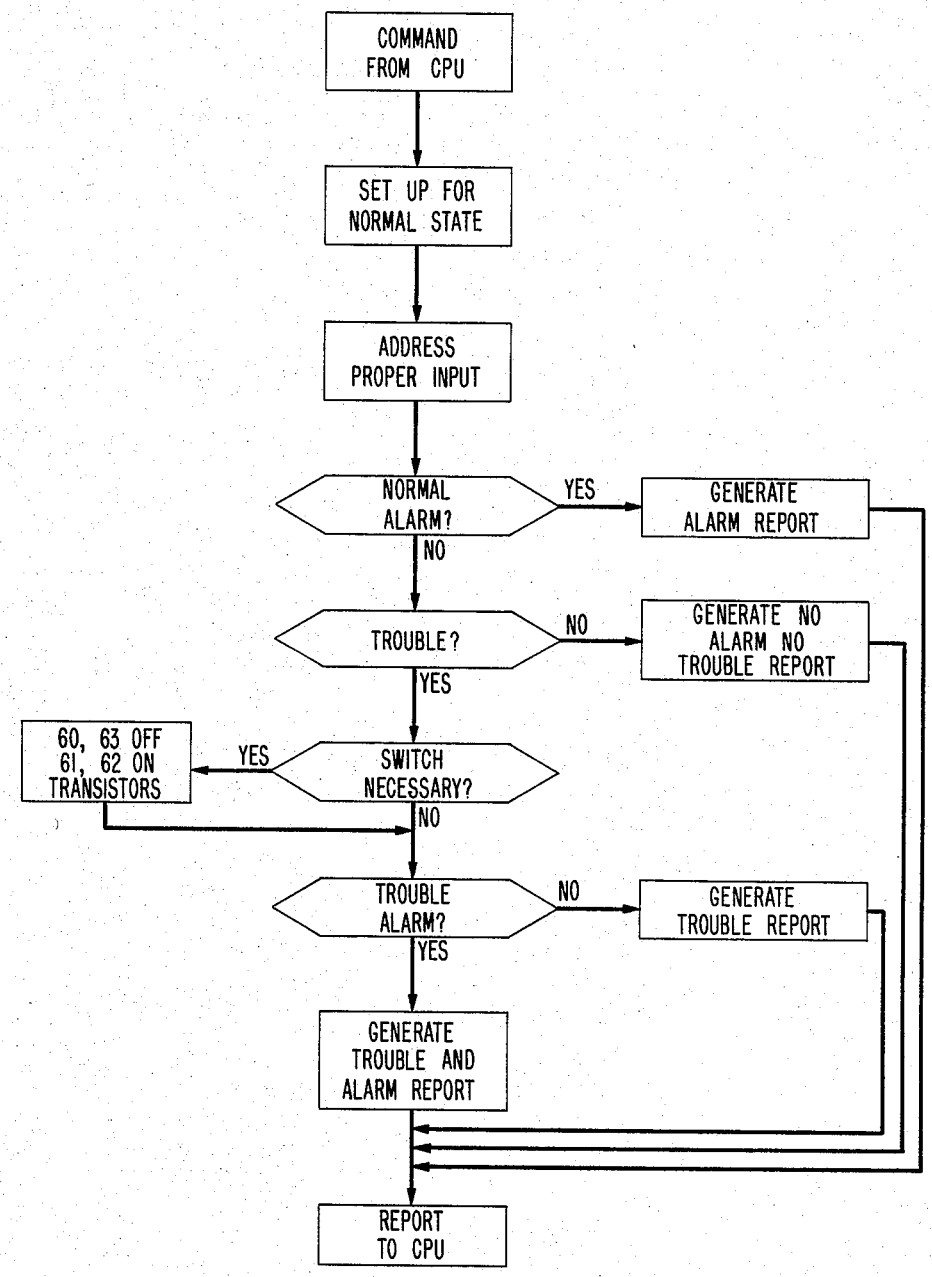
FIG. 3 is a flow chart of alarm system operations.

The operations of the alarm system of FIG. 2 are sequentially controlled by the microcomputer 30 in accordance with the flowchart of FIG. 3. Initially, a command is sent from a CPU (Central processing unit) to activate the microcomputer 30 which, in turn, operates the sensing circuitry 23 for preparing it to sense alarm, nonalarm and/or trouble conditions on the loop conductors to the protected premises. The operation of the sensing circuitry 23 is effected by the microcomputer 30 applying negative potentials over conductors 31 and 32 and positive potentials over conductors 33 and 34 to forward bias transistors 61 and 62 and to reverse bias transistors 60 and 63. As a result, current flow is established in the direction from ground potential through emitter 65, collector 69, resistors 71, 82, 81, 80 and 79, collector 77 and emitter 72 to potential 74. That current flow sets up a combination of voltages on conductors 50–53 which are examined by the comparators 54–59 for supplying the combinational HIGH-LOW logic voltages on conductor 36–40. Next, the microcomputer 30 addresses the multiplexer 14 over conductors 28 and 29 of FIG. 1 for effecting a connection over one of the groups of four loop conductors, illustratively conductors 15–18, extending to alarm sensing contacts, such as contacts 10, at the protected premises.

Upon a closure of the multiplexer 14 contacts 42–45, the voltages on conductors 50–53 are altered due to the shunting effects of the resistors 46–49 and the conductors 15–18 upon the resistors 80 and 82. In the absence of an opened or a shorted-to-ground one of the conductors 15–18 and any closure of the alarm contacts 10, a normal state set of voltages are established on conductor 50–53 to activate selected ones of the comparators 54–59 to supply the combinational HIGH-LOW logic voltages on conductors 35–40 which indicate the nonalarm and nonfault conditions. Illustratively, the HIGH-LOW voltages on conductors 35–40 for this normal state are: $\overline{35}$, $\overline{36}$, $\overline{37}$, 38, 39, $\overline{40}$, or 35, 36, 37 and 40 are LOW and 38 and 39 are HIGH.

An alarm condition signaled by the closure of the sensor contacts 10 causes a different combination of voltages to occur on conductors 50–53 due to the shunting effects of resistors 80–82. The resultant combination of output logic voltages produced by comparators 54–59 on conductors 35–40 due to the signaled alarm and in the absence of an open or short-to-ground one of the conductors 15–18 are identified by the microcomputer 30 and causes it, in turn, to signal the CPU for generating an alarm report.

Various combinations of voltages are produced on conductors 50–53 for the different combinations of non-alarm and alarm conditions and an opened or shorted one of the conductors 15–18. An illustration of the various combinations is set forth hereinafter in a Table I for illustrative values of the resistance of the loop conductors 15–18, the resistors in multiplexer 14 and sensing circuitry 23, and the operating voltages as set forth hereinafter in Table II.

TABLE I

| Condition | $V_{50}$ | $V_{51}$ | $V_{52}$ | $V_{53}$ | State |
|---|---|---|---|---|---|
| Normal | 4.47 | 3.93 | 1.15 | .61 | $\overline{35}$, $\overline{36}$, $\overline{37}$, 38, 39, $\overline{40}$ |
| Normal alarm | 3.45 | 2.62 | 2.45 | 1.63 | $\overline{35}$, 36, $\overline{37}$, 38, $\overline{39}$, $\overline{40}$ |
| 15 open | 4.63 | 2.72 | .81 | .44 | $\overline{35}$, 36, $\overline{37}$, 38, 39, $\overline{40}$ |
| 15 open alarm | 4.4 | 1.33 | 1.0 | .67 | $\overline{35}$, 36, 37, 38, 39, $\overline{40}$ |
| 16 open | 4.63 | 2.72 | .8 | .44 | $\overline{35}$, 36, $\overline{37}$, 38, 39, $\overline{40}$ |
| 16 open alarm | 3.45 | 2.96 | 2.47 | 1.62 | $\overline{35}$, 36, $\overline{37}$, 38, $\overline{39}$, $\overline{40}$ |
| 17 open | 4.63 | 4.27 | 2.35 | .44 | $\overline{35}$, $\overline{36}$, $\overline{37}$, 38, $\overline{39}$, $\overline{40}$ |
| 17 open alarm | 3.46 | 2.6 | 2.11 | 1.62 | $\overline{35}$, 36, $\overline{37}$, 38, $\overline{39}$, $\overline{40}$ |
| 18 open | 4.63 | 4.26 | 2.35 | .44 | $\overline{35}$, $\overline{36}$, $\overline{37}$, 38, $\overline{39}$, $\overline{40}$ |
| 18 open alarm | 4.4 | 4.07 | 3.73 | .67 | $\overline{35}$, $\overline{36}$, $\overline{37}$, $\overline{38}$, $\overline{39}$, $\overline{40}$ |
| 17 or 18 shorted | 4.35 | 3.69 | .36 | .05 | $\overline{35}$, $\overline{36}$, $\overline{37}$, 38, 39, 40 |
| 17 or 18 shorted alarm | 1.84 | .18 | .03 | .03 | $\overline{35}$, 36, 37, 38, 39, 40 |
| 15 or 16 shorted | 1.84 | .19 | .1 | .08 | $\overline{35}$, 36, 37, 38, 39, 40 |
| 15 or 16 shorted (switch) | .05 | .36 | 3.68 | 4.34 | 35, 36, 37, $\overline{38}$, $\overline{39}$, $\overline{40}$ |
| 15 or 16 shorted (switch) alarm | .02 | .02 | .18 | 1.82 | 35, 36, 37, 38, 39, $\overline{40}$ |
| Short removed | 1.61 | 2.43 | 2.6 | 3.43 | $\overline{35}$, 36, $\overline{37}$, 38, $\overline{39}$, $\overline{40}$ |

TABLE II

| | |
|---|---|
| loop resistance | 953 ohms |
| resistors 46–49 | 476 ohms |
| resistors 70, 71 | 2 kilohms |
| 79, 83 | 2 kilohms |
| resistors 80–82 | 10 kilohms |
| voltage 74 | 5 volts |
| voltage 84, 86, 88 | 1.5 volts |
| voltage 85, 87 | 3.5 volts |
| voltage 89 | .3 volts |

What is claimed is:

1. A signaling system comprising a first pair of loop conductors, a second pair of loop conductors, contact means for signaling an occurrence of an alarm, said contact means comprising a first contact connected to said first pair of loop conductors and a second contact connected to said second pair of loop conductors, and an electrical network means connected to said first and second pairs of loop conductors and being responsive to impedance conditions of individual ones of said loop conductors and said first and second contacts for producing a plurality of combinational logic voltages the combination of which indicates the operative state of said contact means and sensed fault conditions on said individual conductors.

2. The invention of claim 1 wherein said electrical network means comprises a resistor arrangement cooperating with said impedance conditions for deriving voltages representing the operative state of said contact means and said sensed fault conditions and means responsive to the voltages derived from said resistor arrangement for supplying said plurality of combinational logic voltages indicating sensed alarm and fault signaling conditions.

3. The invention of claim 2 wherein said supplying means comprises a plurality of reference voltages and means for comparing said reference voltages with voltages derived from said resistor arrangement for producing a plurality of combinational output logic voltages indicating an open and a shorted-to-ground fault condition of any one conductor of said connected ones of said first and second pairs of loop conductors and an alarm and nonalarm signaled by said first and second contacts connected thereto.

4. The invention of claim 3 further comprising means responsive to a receipt of said plurality of combinational output logic voltages for identifying said fault condition and an alarm and nonalarm condition.

5. The invention of claim 2 wherein said electrical network further comprises switching means responsive to a receipt of control signals for controlling a bidirectional flow of current through said resistor arrangement to derive said voltages representing said sensed alarm and fault conditions.

6. The invention of claim 5 wherein said switching means comprises switch circuitry responsive to a receipt of a first set of control voltages for controlling a unidirectional flow of current through said resistor arrangement and switch means responsive to a receipt of a second set of control voltages for controlling a second unidirectional flow of current through said resistor arrangement.

7. The invention of claim 6 wherein said resistor arrangement comprises first, second and third resistors connected in series and said switch circuitry and switch means each comprises transistor switching circuitry serially connected with said first, second, and third resistors.

8. The invention of claim 7 wherein said transistor comprises first and second resistor means serially connected with said first, second and third resistors, an NPN transistor and a PNP transistor activated in response to a receipt of said first set of control signals for supplying said unidirectional current flow through said first, second and third resistors and said first and second resistor means.

9. The invention of claim 8 wherein said transistor switching circuitry further comprises third and fourth resistor means serially connected with said first, second and third resistors, and another PNP transistor and another NPN transistor activated in response to a receipt of said second set of control signals for reversing said unidirectional current flow through said first, second and third resistors via said third and fourth resistor means.

10. The invention of claim 9 further comprising means for supplying said first set of control signals and being responsive to a prescribed combinational ones of said logic voltages for interrupting the supplying of said first set of control signals and supplying said second set of control signals.

11. In an alarm system having a first pair of loop conductors, a second pair of loop conductors and contact means for signaling an occurrence of an alarm, said contact means comprising a first contact connected to said first pair of loop conductors and a second contact connected to said second pair of loop conductors, the invention comprising an electrical circuit arrangement comprising resistor means connectable to said first and second pairs of conductors, means for controlling current flow through said resistor means and said first and second pairs of loop conductors and means responsive to voltage produced across said resistor means in response to said current flow for supplying combinational logic voltages the combination of which indicates an alarm condition signaled by said contact means and fault impedance conditions of individual ones of said loop conductors.

12. The invention of claim 11 further comprising control means for sequentially controlling the operation of said current flow controlling means and an identification of alarm and fault conditions indicated by the supplied combinational logic voltages.

13. The invention of claim 12 further comprising connector means operable for connecting said first and second pairs of loop conductor and wherein said control means sequentially controls the operation of said connector means to effect the connection of said first and second pairs of loop conductors to said resistor means following said operation of said current flow controlling means.

14. The invention of claim 11 wherein said current flow controlling means comprises a transistor switching arrangement.

15. The invention of claim 14 wherein said transistor switching arrangement comprises NPN transistor and PNP transistor circuitry for controlling current flow in each direction through said resistor means.

16. The invention of claim 15 wherein said resistor means comprises a plurality of resistors serially connected with said NPN transistor and PNP transistor circuitry.

17. The invention of claim 16 wherein said combinational logic voltages supplying means comprises a plurality of comparator circuits responsive to combinations of voltages produced across said plurality of resistors in response to said current flow for supplying said combinational logic voltages indicating said alarm condition signaled by said alarm condition signaled by said contact means and fault impedance conditions of said first and second pairs of said loop conductors.

18. In an alarm system having a first pair of loop conductors, a second pair of loop conductors and contact means for signaling an occurrence of an alarm, said contact means comprising a first contact connected to said first pair of loop conductors and a second contact connected to said second pair of loop conductors, the invention comprising sensing means connectable to said first and second pairs of loop conductors and being responsive to impedance conditions of individual ones of said loop conductors and said first and second contacts for producing a plurality of combinational logic voltages the combination of which indicates sensed alarm and individual conductor fault conditions, means for effecting a connection of said sensing means to said first and second pairs of loop conductors, and means responsive to said plurality of combinational logic voltages for identifying each of said sensed alarm and fault conditions.

19. An alarm system comprising:

a plurality of alarm signaling devices each of which comprises a first pair of loop conductors, a second pair of loop conductors and contact means for signaling an occurrence of an alarm, said contact means comprising a first contact connected to said first pair of loop conductors and a second contact connected to said second pair of loop conductors;

sensing circuitry time shared by each of said alarm signaling devices and being connectable to each of said first and second pair of loop conductors of each of said plurality of alarm signaling devices;

multiplexer means responsive to a receipt of address signals for sequentially connecting said sensing circuitry individually to each of said plurality of signaling devices; and said sensing circuitry comprising an electrical network means responsive to impedance conditions of individual connected ones of said loop conductors and said first and second contacts connected thereto for producing a plurality of combinational logic voltages the combination of which indicates the operative state of said contact means and fault conditions on said individual conductors.

20. The invention of claim 19 further comprising means generating said address signals for effecting an identification of said sensed alarm and fault conditions in response to the produced plurality of combinational logic voltages.

21. The invention of claim 19 wherein said electrical network means comprises a resistor arrangement cooperating with said impedance conditions for deriving voltages representing said sensed alarm and fault conditions and means responsive to the voltages derived from said resistor arrangement for supplying said plurality of combinational logic voltages indicating said sensed alarm and fault conditions.

22. The invention of claim 21 wherein said supplying means comprises a plurality of reference voltages and voltages derived from said resistor arrangement with said reference voltages for producing a plurality of combinational output logic voltages indicating an open and a shorted-to-ground fault condition of any one conductor of said connected ones of said first and second pair of loop conductors and an alarm and non-alarm signaled by said first and second contacts connected thereto.

23. The invention of claim 22 further comprising means responsive to a receipt of said plurality of combinational output logic voltages for identifying said fault condition and an alarm and nonalarm condition.

24. The invention of claim 22 wherein said electrical network means further comprises switching means responsive to a receipt of control signals for controlling a bidirectional flow of current through said resistor arrangement to derive said voltages representing said sensed alarm and fault conditions.

25. The invention of claim 24 wherein said switching means comprises switch circuitry responsive to a receipt of a first set of control voltages for controlling a unidirectional flow of current through said resistor arrangement and being further responsive to a second set of control voltages for controlling a reversal of said unidirectional flow of current through said resistor arrangement.

26. The invention of claim 25 wherein said resistor arrangement comprises first, second and third resistors connected in series and said switch circuitry comprises transistor switching circuitry serially connected with said first, second and third resistors.

27. The invention of claim 26 wherein said transistor switching circuitry comprises first and second resistor means serially connected with said first, second and third resistors, a first NPN transistor and a first PNP transistor activated in response to a receipt of said first set of control signals for supplying said unidirectional current flow through said first, second and third resistors via said first and second resistor means, third and fourth resistor means serially connected with said first, second and third resistors, and a second PNP transistor and a second NPN transistor activated in response to a receipt of said second set of control signals for reversing said unidirectional current flow through said first, second and third resistors via said third and fourth resistor means.

* * * * *